US008789449B1

(12) United States Patent
Saito

(10) Patent No.: US 8,789,449 B1
(45) Date of Patent: Jul. 29, 2014

(54) PIERCING APPARATUS WITH SCRAP REMOVING CAPABILITY

(71) Applicant: Hirofumi Saito, Chula Vista, CA (US)

(72) Inventor: Hirofumi Saito, Chula Vista, CA (US)

( * ) Notice: Subject to any disclaimer, the term of this patent is extended or adjusted under 35 U.S.C. 154(b) by 0 days.

(21) Appl. No.: 14/074,559

(22) Filed: Nov. 7, 2013

(51) Int. Cl.
*B21D 28/16* (2006.01)
*B26F 1/14* (2006.01)

(52) U.S. Cl.
CPC ..... *B21D 28/16* (2013.01)
USPC ..... 83/23; 83/124; 83/684

(58) Field of Classification Search
USPC ..... 83/124, 125, 126, 128, 134, 136, 145, 83/146, 166, 184, 660, 684, 685, 690, 23, 83/50
See application file for complete search history.

(56) References Cited

U.S. PATENT DOCUMENTS

| | | | | |
|---|---|---|---|---|
| 1,631,323 | A * | 6/1927 | Loesel | 83/146 |
| 4,048,890 | A * | 9/1977 | Aeschbach | 83/146 |
| 6,102,268 | A * | 8/2000 | Raveleau | 225/103 |
| 8,640,518 | B1 * | 2/2014 | Saito | 72/325 |

* cited by examiner

*Primary Examiner* — Stephen Choi
(74) *Attorney, Agent, or Firm* — LambentIP

(57) ABSTRACT

A piercing apparatus is provided, including a piercing die including a first section and a second section, the first section having a top surface for a workpiece to be placed on and internal surfaces surrounding a first hollow formed vertically, the second section placed in the first hollow and having an internal side surface surrounding a second hollow formed vertically, a piercing punch having a tip portion for punching the workpiece to cut off a scrap piece to produce a hole in the workpiece, and a scrap removing unit that is formed to be planar and fixed horizontally between the first section and the second section. The scrap removing unit is configured for the tip portion attached with the scrap piece after the punching to move through while the tip portion is lowered, and is further configured to scrape off the scrap piece from the tip portion while the tip portion is lifted through the scrap removing unit.

11 Claims, 6 Drawing Sheets

PIERCING APPARATUS WITH SCRAP REMOVING CAPABILITY

BACKGROUND

Piercing is a machining technique involving punching a hole in a workpiece such as a metal sheet. A piercing apparatus typically includes a piercing punch and a piercing die. A workpiece is placed on the top stage of the die that has a piercing hollow therein, and the tip of the piercing punch is pressed onto the workpiece so as to make a hole in the workpiece by punching off the corresponding piece. The shape of the hole can be made to be a circle, an oval, a square, a rectangle, a star, a triangle, a hexagon, a polygon, etc. by selecting the cross-sectional shape of the piercing punch and the piercing hollow according to the needed shape. There are a variety of piercing operations, including but not limited to: perforating that involves punching a large number of closely spaced holes; notching that removes material from the edge of the workpiece; and nibbling that cuts off material with a contour by producing a series of overlapping holes, slits or notches, allowing for complex shapes to be formed in the workpiece. These punched-off pieces are scraps that need to be discarded properly. In a conventional piercing process, however, it is often the case that, due to magnetization, static-electricity or vacuuming effects, these scraps get attached to the tip of the piercing punch, thereby interfering with the subsequent punching operation, or fall off from the tip and attached to the vicinity of the newly formed hole, thereby requiring cleaning of the product.

DETAILED DESCRIPTION

Figure 1:
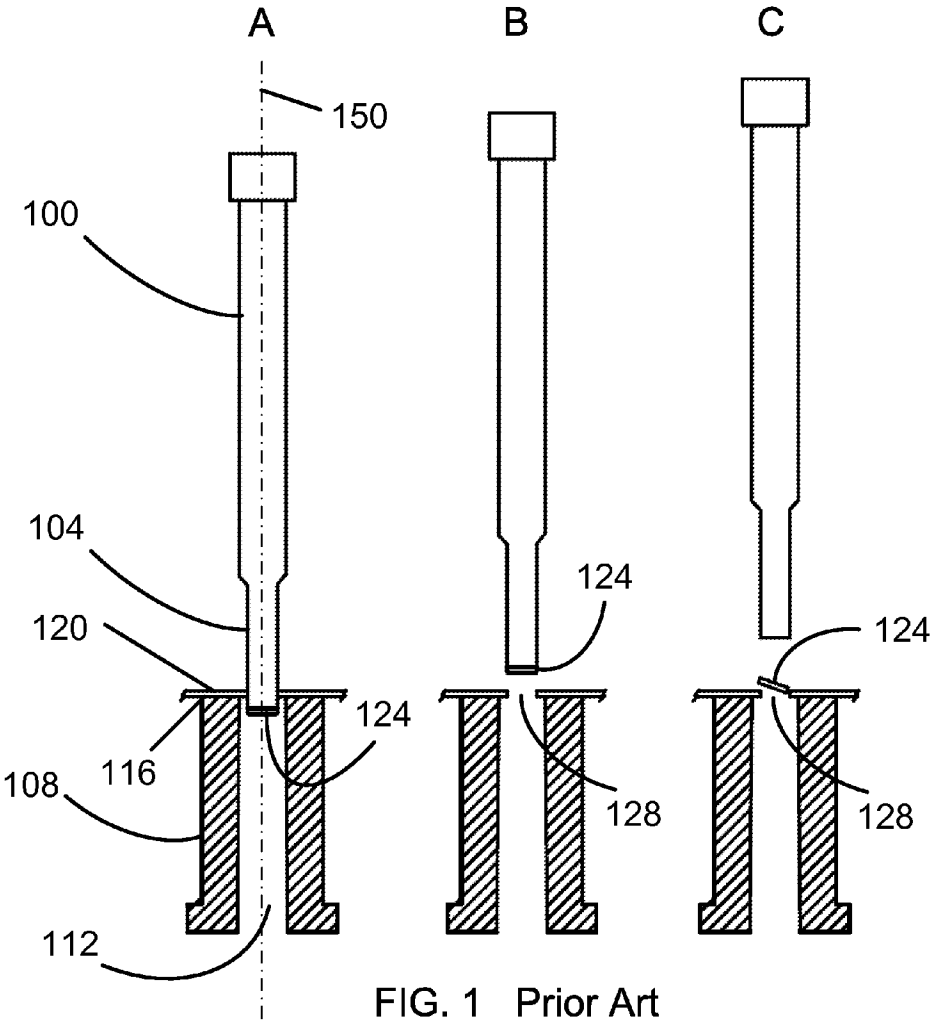
FIG. 1 Prior Art
FIG. 1 illustrates an example of piercing process, where a conventional piercing apparatus is used.

FIG. 1 illustrates an example of piercing process, A-B-C, where a conventional piercing apparatus is used. The conventional piercing apparatus includes a piercing punch 100 having a tip portion 104 and a piercing die 108. The piercing die 108 has a piercing hollow 112 that is formed inside the piercing die 108 for the tip portion 104 to move downward therein during the piercing operation. The piercing punch 100 and the piercing die 108 are placed with respect to each other so that the center of the horizontal cross section of the piercing punch 100 and that of the piercing hollow 112 coincide, defining a center axis 150 along the vertical direction. Namely, the piercing punch 100 and the piercing die 108 are placed concentrically to each other. Each step of the piercing process is illustrated by a cross-sectional side view with respect the vertical plane including the center axis 150. The shape of the horizontal cross section of the tip portion 104 and that of the piercing hollow 112 can be determined depending on the needed shape of a hole to be made, such as a circle, an oval, a square, a rectangle, a star, a triangle, a hexagon, a polygon, etc. The top surface of the piercing die 108 is a stage 116 for a workpiece 120 to be placed on. Step A illustrates that the workpiece 120 is placed on the stage 116 of the piercing die 108, and the piercing punch 100 is lowered vertically into the piercing hollow 112 to press the workpiece 120, thereby cutting off a scrap piece 124 by the tip portion 104. In step B, the piercing punch 100 is lifted above the workpiece, and a hole 128 is formed in the workpiece 120. However, in the conventional case, there are instances where the scrap piece 124 is still attached to the end point of the tip portion 104, due possibly to magnetization, static-electricity or vacuum effects, after fabricating the desired product with the hole 128. Furthermore, there is a possibility that the scrap metal 124 detaches itself from the tip portion 104 and falls onto the workpiece 120 in the vicinity of the formed hole 128, as illustrated in step C. Therefore, without proper discard, the scrap metal 124 can interfere with the subsequent piercing operation, generating scratches in the resultant product, or even damaging the tip portion 104.

In view of the above problems associated with the generation of scrap pieces during the piercing operation, the present document describes a new type of piercing apparatus comprising a piercing punch, a piercing die and a scrap removing unit attached to the piercing die. Details of the piercing apparatus according to present embodiments are explained below with reference to the subsequent drawings.

Figure 2A:
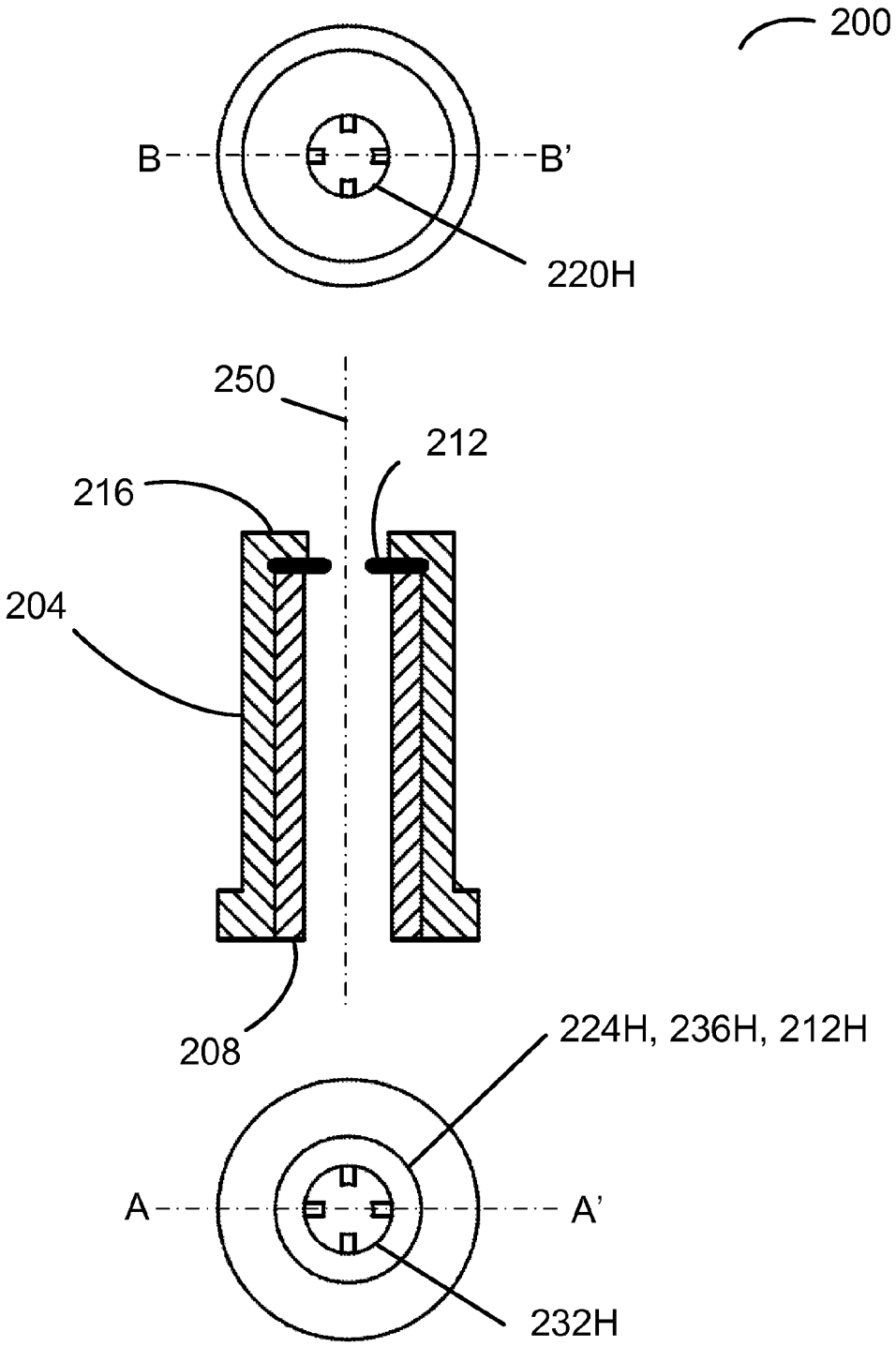
FIGS. 2A-2D illustrates an example of a piercing die and a scrap removing unit attached thereto according to an embodiment.
Figures 2B, 2C, 2D:
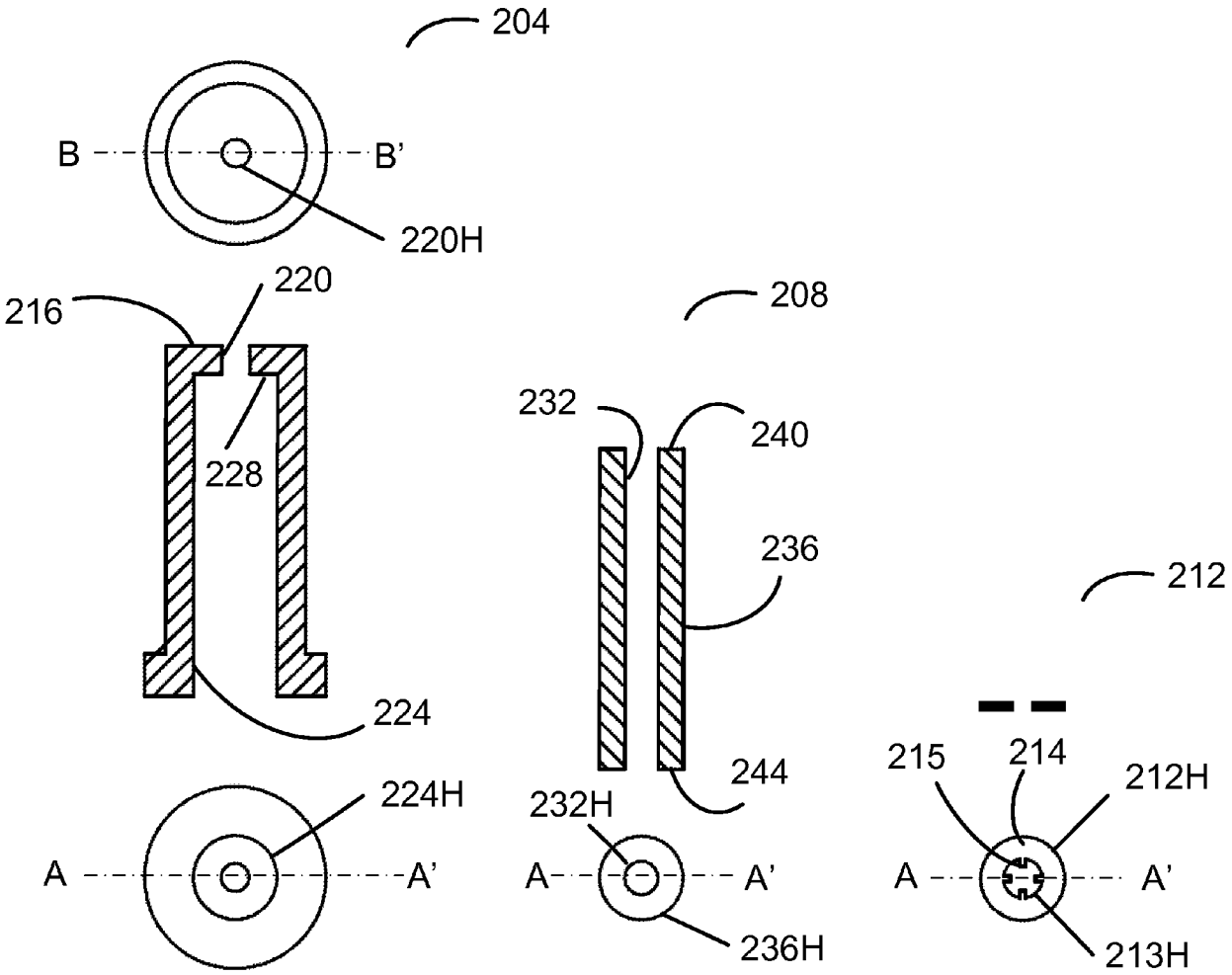

FIGS. 2A-2D illustrates an example of a piercing die and a scrap removing unit attached thereto according to an embodiment. FIG. 2A illustrates the whole assembly 200. FIGS. 2B-2D illustrate a first section 204 of the piercing die, a second section 208 of the piercing die, and the scrap removing unit 212, respectively and separately. In FIGS. 2A and 2B, the horizontal cross sectional view from the bottom is illustrated in the bottom figure, the horizontal cross sectional view from the top is illustrated in the top figure, and the vertical cross sectional view along the cut including the lines A-A' and B-B' is illustrated in the middle figure. In FIGS. 2C and 2D, the horizontal cross sectional view from the bottom is illustrated in the bottom figure, and the vertical cross sectional view along the cut including the line A-A' is illustrated in the top figure, where top view and the bottom view are identical in this example.

In the example of FIGS. 2A-2D, the first section 204 has a stage 216 for a workpiece to be placed on, and a hollow is formed vertically along the center axis 250 in the first section 204, providing a first internal surface 220 and a second internal surface 224, which are contiguously connected via a third internal surface 228 that is an internal shoulder surface. The first internal surface 220 is connected contiguously to the stage 216, providing an opening defined by the horizontal cross section 220H. Although not shown here, the piercing punch is placed for the piercing operation so that its center axis coincides with the center axis 250. The piercing punch is lowered through the opening 220H to punch the workpiece to produce a hole. The horizontal cross section 22011 of the first internal surface 220 is circular in this example for the use of making a circular hole. However, as mentioned earlier, the shape of the horizontal cross section 220H of the first internal surface 220 as well as that of the tip portion of the piercing punch can be configured to be a circle, an oval, a square, a rectangle, a star, a triangle, a hexagon, a polygon, etc., depending on the needed shape of a hole to be made. Namely, the volume surrounded by the first internal surface 220 may be cylindrically symmetric or rotationally symmetric around the center axis 250. The volume surrounded by the second internal surface 224 may be of a cylinder.

The second section 208 of the piercing die in the present example is configured to have an internal side surface 232, an external side surface 236, a top surface 240, and a bottom surface 244, the internal side surface 232 surrounding a hollow formed vertically. The shape of the top surface 240 and that of the bottom surface 244 are the same in this example, each bounded by two concentric circles, which are horizontal cross sections 232H and 236H of the internal side surface 232 and the external side surface 236, respectively. The second section 208 is placed inside the hollow of the first section 204 against the second internal surface 224 of the first section 204. As mentioned earlier, the shape of the horizontal cross section of the tip portion of the piercing punch can be configured to be a circle, an oval, a square, a rectangle, a star, a triangle, a hexagon, a polygon, etc., depending on the needed shape of a hole to be made. In general, the shape is rotationally symmetric. Accordingly, the horizontal cross section 232H of the internal side surface 232 may be configured to have a corresponding shape.

As illustrated in FIG. 2D, the scrap removing unit 212 to be attached to the piercing die is a planar unit. The scrap removing unit 212 includes a base portion 214 and two or more multiple flaps 215. The case of having four rectangular flaps is shown in this example. The base portion 214 is bound by two bounds 212H and 213H, which are two concentric circles 212H and 213H in this example. The multiple flaps 215 are radially formed so as to point toward the center of the circle 213H, each of the flaps connected to the base portion 214 at one end. The base portion 214 is configured to be inserted and held securely between the third internal surface 228 of the first section 204 and the top surface 240 of the second section 208. The inner bound 213H is circular in this example for the use of making a circular hole. However, as mentioned earlier, the shape of the horizontal cross section of the tip portion of the piercing punch can be configured to be a circle, an oval, a square, a rectangle, a star, a triangle, a hexagon, a polygon, etc., depending on the needed shape of a hole to be made. Accordingly, the inner bound 213H may be configured to have a corresponding shape.

As illustrated in FIG. 2A, the assembly of the piercing die with the scrap removing capability according to the embodiment includes the first section 204, the scrap removing unit 212 placed horizontally under the third internal surface 228 that is the internal shoulder surface of the first section 204, and the second section 208 inserted and fit to the second internal surface 224 of the first section 204 so as to position securely the scrap removing unit 212 against the third internal surface 228. Therefore, in the assembly of FIG. 2A, the horizontal cross sections 224H, 236H and 212H substantially correspond with each other.

Figure 3:
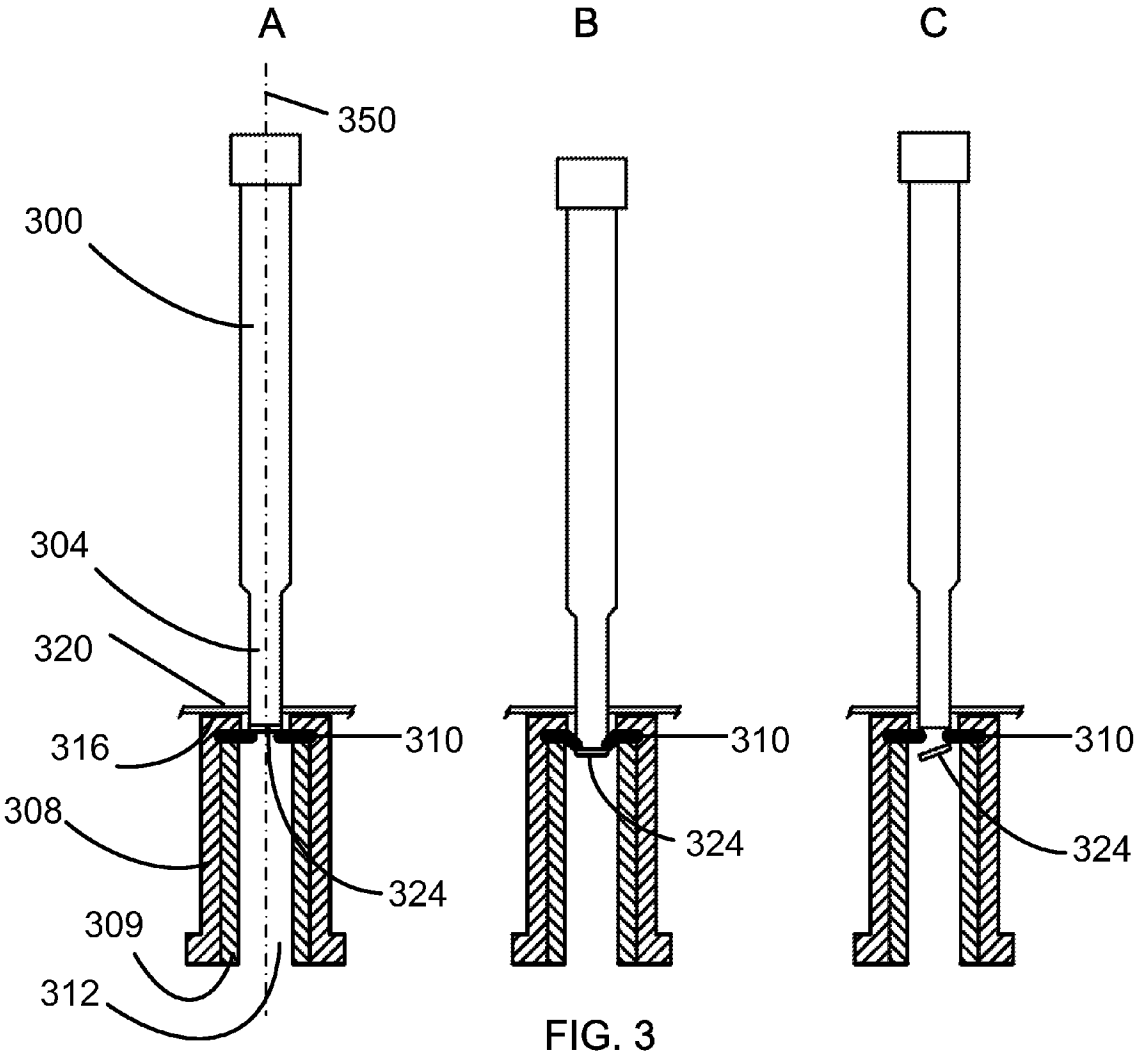
FIG. 3 illustrates an example of piercing process, where a piercing apparatus according to an embodiment is used.

FIG. 3 illustrates an example of piercing process, A-B-C, where a piercing apparatus according to an embodiment is used. The piercing apparatus includes a piercing punch 300 having a tip portion 304 and a piercing die having the scrap removing capability, an example of which is illustrated in FIGS. 2A-2D. Namely, the present piercing die includes the first section 308, the second section 309, and the scrap removing unit 310 placed under the internal shoulder surface of the first section 308, the position of the scrap removing unit 310 being secured by the second section 309. Thus, the scrap removing unit 310 is horizontally fixed between the first section 308 and the second section 309. The piercing die has a piercing hollow 312 therein for the tip portion 304 to move downward during the piercing operation. The piercing punch 300 and the piercing hollow 312 are placed with respect to each other so that the center of the horizontal cross section of the piercing punch 300 and that of the piercing hollow 312 coincide, defining a center axis 350 along the vertical direction. The scrap removing unit 310 includes multiple flaps, such as 215 of FIG. 2D, which are radially formed so as to point toward the center axis 350, each of the flaps being connected to the base portion, such as 214 of FIG. 2D, at one end. Each step of the piercing process is illustrated by a cross-sectional side view with respect the vertical plane including the center axis 350. The top surface 316 of the first section 308 of the piercing die is a stage 316 for a workpiece 320 to be placed on.

Step A illustrates that the workpiece 320 is placed on the stage 316, and the piercing punch 300 is lowered vertically into the piercing hollow 312 to press the workpiece 320, thereby cutting off a scrap piece 324 by the tip portion 304. At this instance, the scrap 324 is attached to the tip portion 304 of the piercing punch 300, and the tip portion 304 has not yet reached the scrap removing unit 310. In step B, the tip portion 304 with the scrap 324 attached thereto is further lowered to move through the scrap removing unit 310, bending downward the flaps, such as 215 of FIG. 2D, of the scrap removing unit 310. In step C, the piercing punch 300 is lifted and the tip portion 304 is lifted through the scrap removing unit 310, wherein the flaps scrape off the scrap 324 from the tip portion 304 while bending back to the original planar position.

Figure 4B:
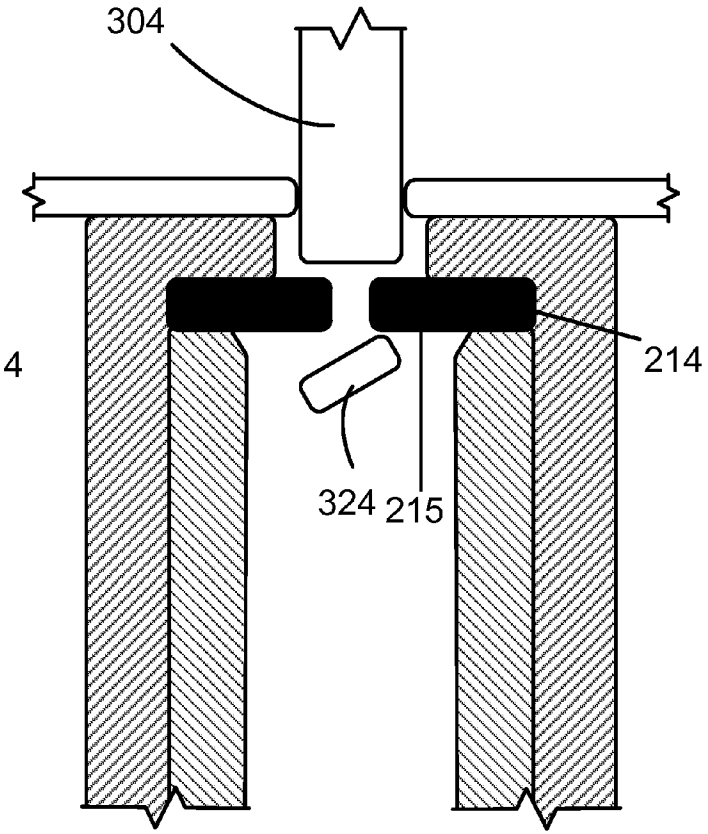
FIGS. 4A and 4B illustrate an expanded view of steps B and C in the piercing process illustrated in FIG. 3.
Figure 4A:
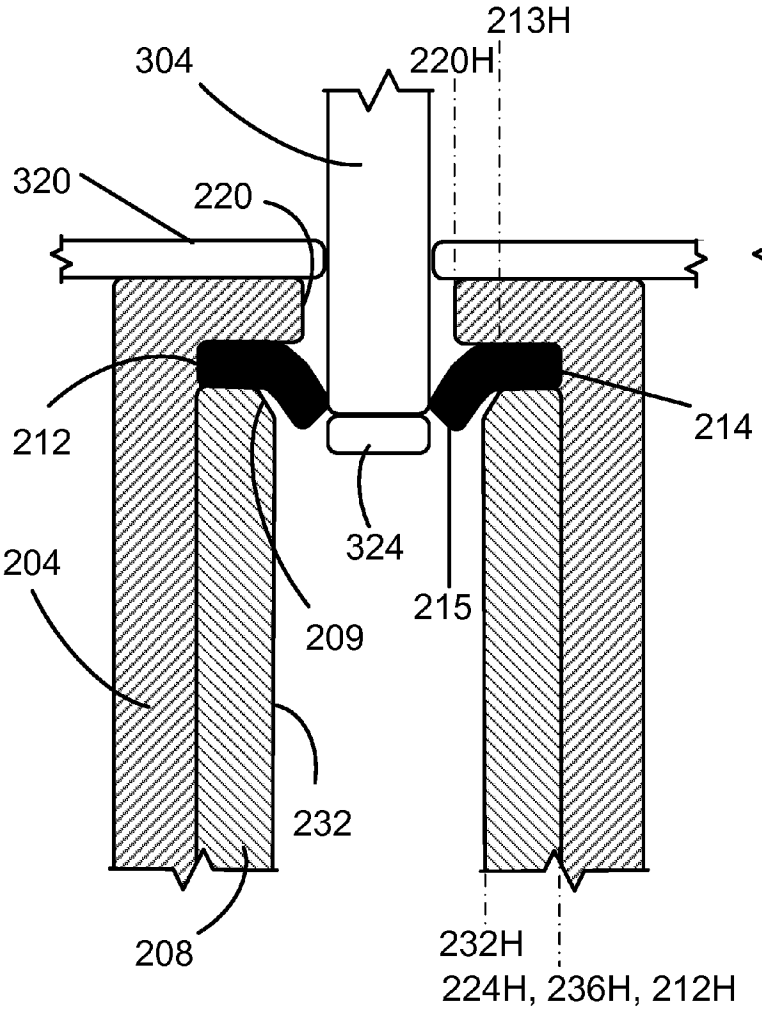

FIGS. 4A and 4B illustrate an expanded view of steps B and C in the piercing process illustrated in FIG. 3. Here, details around the scrap removing unit 310 are described using the example of the piercing die attached with the scrap removing unit illustrated in FIGS. 2A-2D. In step B illustrated in FIG. 4A, the tip portion 304 with the scrap 324 attached thereto is lowered to move through the scrap removing unit 212, bending downward the flaps 215 of the scrap removing unit 212. In step C illustrated in FIG. 4B, the tip portion 304 is lifted through the scrap removing unit 212, wherein the flaps 215 scrape off the scrap 324 from the tip portion 304 while bending back to the original planar position. At least the base portion 214 of the scrap removing unit 212 is held securely between the first section 204 and the second section 208. The top edge portion 209 of the internal side surface 232 of the second section 208 may be rounded or chamfered so that the flaps 215 undergo smooth bending over it with less mechanical stress than bending over a sharp corner.

The diameter of 232H may be configured to be larger than that of 220H to enhance the probability of preventing a scrap, once removed from the tip portion 304, from attaching to the internal side surface 232 of the second section 208. The diameter of 213H may be configured to be larger than that of 232H, so that only the flaps 215, not a part of the base portion 214, are exposed in the hollow surrounded by the internal side surface 232 of the second section 208. When the shape of the horizontal cross section 220H of the first internal surface 220 of the first section 204, the shape of the horizontal cross section 232H of the internal side surface 232 of the second section 208, or the shape of the inner bound 213H of the base portion 214 of the scrap removing unit 212 is different from a circle, the longest diagonal of the selected shape is used for the above size comparison. To produce a hole with required shape and dimensions with good accuracy, the cross section of the tip portion 304 and 220H of the first internal surface 220 of the first section 204 need to have the same shape. Since the diameter/diagonal of 220H may be smaller than that of 232H, which may be smaller than that of 213H, the shapes of 232H and 213H may not have to be the same as the required shape of a hole to be made. However, by setting these shapes of 232H and 213H to be the same as the required shape of a hole to be made, and thus the same as the shape of the scrap 324 and the cross section of the tip portion 304, the stress distribution become favorable during the scrap removing process, resulting in better scrap removing efficiency than otherwise.

As the piercing punch 300 moves up and down many times during the piercing operation, the flaps 215 of the scrap removing unit 212 are pushed down and released up by the tip portion 304 many times, thereby undergoing multiple flapping motions during the piercing operation. Therefore, it is preferable that the scrap removing unit 212 is made of a material that is elastic, mechanically durable and non-magnetic, such as a stainless steel.

Figure 5:
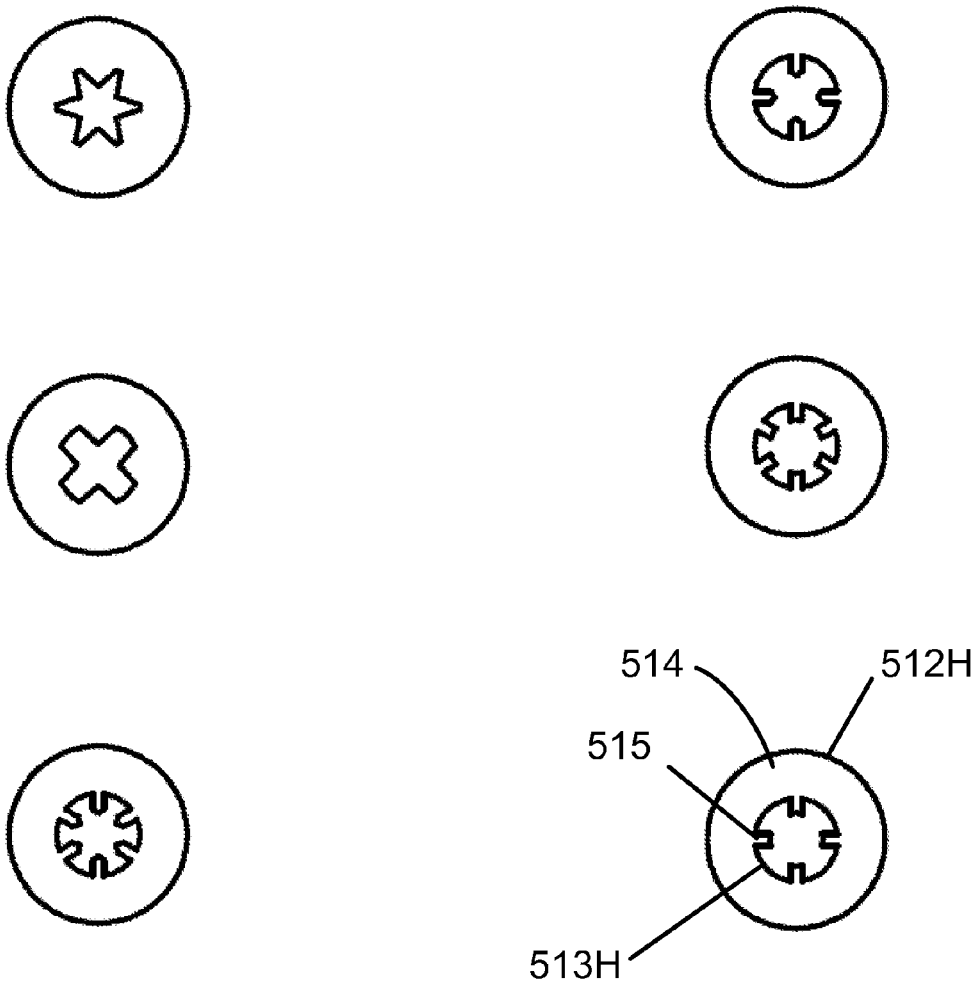
FIG. 5 illustrates examples of shapes of the scrap removing unit.

FIG. 5 illustrates examples of shapes of the scrap removing unit. Similar to the example illustrated in FIG. 2D, the scrap removing unit to be attached to the piercing die is a planar unit. In FIG. 5, each of the examples includes a base portion 514 and two or more multiple flaps 515. The base portion 514 is bound by two bounds 512H and 513H, which are two concentric circles in this example. The multiple flaps 515 are radially formed so as to point toward the center, each of the flaps connected to the base portion 514 at one end. The inner bound 513H is circular in this example for the use of making a circular hole. However, as mentioned earlier, the shape of the horizontal cross section of the tip portion of the piercing punch can be configured to be a circle, an oval, a square, a rectangle, a star, a triangle, a hexagon, a polygon, etc., depending on the needed shape of a hole to be made. Accordingly, the inner bound 513H may be configured to have a corresponding shape. In general, the shape of the scrap removing unit may be configured to be rotationally symmetric. A wide variety of shapes of the scrap removing unit can be configured and used, including but not limited to the examples illustrated in FIG. 5.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A piercing apparatus comprising:

a piercing die including a first section and a second section, the first section having a top surface for a workpiece to be placed on and internal surfaces surrounding a first hollow formed vertically, the second section placed in the first hollow and having an internal side surface surrounding a second hollow formed vertically;

a piercing punch having a tip portion for punching the workpiece to cut off a scrap piece to produce a hole in the workpiece; and a scrap removing unit that is formed to be planar and fixed horizontally between the first section and the second section, wherein the first section, the second section and the piercing punch are placed so that center axes of the first hollow, the second hollow and the piercing punch coincide, and the scrap removing unit is configured for the tip portion attached with the scrap piece after the punching to move through while the tip portion is lowered, and is further configured to scrape off the scrap piece from the tip portion while the tip portion is lifted through the scrap removing unit, wherein the internal surfaces of the first section comprise a first internal surface connecting contiguously to the top surface providing an opening, a second internal surface, and a third internal surface connecting contiguously the first and second internal surfaces; and the scrap removing unit comprises a base portion and a plurality of flaps radially formed to point toward the center axis, each of the plurality of flaps connected to the base portion at one end, wherein the second section is placed in the first hollow against the second internal surface of the first section; and at least the base portion of the scrap removing unit is placed under the third internal surface of the first section and positioned securely by the second section.

2. The piercing apparatus of claim 1, wherein the tip portion attached with the scrap piece after the punching is lowered to move through the scrap removing unit, bending downward the plurality of flaps, which then scrape off the scrap piece from the tip portion while bending back to the planar position as the tip portion is lifted through the scrap removing unit.

3. The piercing apparatus of claim 1, wherein a top edge portion of the internal side surface of the second section is configured to be rounded or chamfered.

4. The piercing apparatus of claim 1, wherein a horizontal cross section of the first internal surface of the first section has a shape corresponding to a horizontal cross section of the tip portion to produce the hole having the shape.

5. The piercing apparatus of claim 4, wherein a horizontal cross section of the internal side surface of the second section has the shape.

6. The piercing apparatus of claim 5, wherein the base portion of the scrap removing unit is defined by an inner bound and an outer bound, each of the plurality of flaps connected to the inner bound of the base portion at one end, and the inner bound of the base portion has the shape.

7. The piercing apparatus of claim 4, wherein the shape is a circle, an oval, a square, a rectangle, a star, a triangle, a hexagon, a polygon, or other rotationally symmetric shape.

8. The piercing apparatus of claim 5, wherein a diameter or a longest diagonal of the shape of the horizontal cross section of the internal side surface of the second section is larger than a diameter or a longest diagonal of the shape of the horizontal cross section of the first internal surface of the first section.

9. The piercing apparatus of claim 6, wherein a diameter or a longest diagonal of the shape of the inner bound of the base portion of the scrap removing unit is larger than a diameter or a longest diagonal of the shape of the horizontal cross section of the internal side surface of the second section.

10. A piercing method using a piercing apparatus comprising: a piercing die including a first section and a second section, the first section having a top surface for a workpiece to be placed on and internal surfaces surrounding a first hollow formed vertically, the second section placed in the first hollow and having an internal side surface surrounding a second hollow formed vertically; a piercing punch having a tip portion; and a scrap removing unit that is formed to be planar and fixed horizontally between the first section and the second section, the method comprising:

placing a workpiece on the top surface of the first section;

first lowering the piercing punch to press by the tip portion the workpiece downward to cut off a scrap piece to produce a hole in the workpiece;

second lowering, further from the first lowering, the piercing punch to move the tip portion attached with the scrap piece through the scrap removing unit; and lifting, from the second lowering, the piercing punch to scrape off the scrap piece from the tip portion by the scrap removing unit, wherein the internal surfaces of the first section comprise a first internal surface connecting contiguously to the top surface providing an opening, a second internal surface, and a third internal surface connecting contiguously the first and second internal surfaces; and the scrap removing unit comprises a base portion and a plurality of flaps radially formed to point toward a center axis, each of the flaps connected to the base portion at one end, wherein the second section is placed in the first hollow against the second internal surface of the first section; and at least the base portion of the scrap removing unit is placed under the third internal surface of the first section and positioned securely by the second section.

11. The piercing method of claim 10, wherein the tip portion attached with the scrap piece is lowered in the second lowering to move through the scrap removing unit, bending downward the plurality of flaps, which then scrape off the scrap piece from the tip portion while bending back to the planar position in the lifting.

* * * * *